US006539866B1

(12) United States Patent
Osawa et al.

(10) Patent No.: US 6,539,866 B1
(45) **Date of Patent: *Apr. 1, 2003**

(54) PROCESS FOR PREPARING INK JET SYSTEM PRINTING PLATE

(75) Inventors: Sadao Osawa, Shizuoka (JP); Eiichi Kato, Shizuoka (JP); Hiroyuki Ohishi, Shizuoka (JP); Kazuo Ishii, Shizuoka (JP)

(73) Assignee: Fuji Photo Film Co., Ltd., Kanagawa (JP)

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 837 days.

(21) Appl. No.: 08/888,759

(22) Filed: Jul. 7, 1997

(30) Foreign Application Priority Data

Jul. 12, 1996 (JP) ..... 8-203025

(51) Int. Cl.[7] ..... B41C 1/10
(52) U.S. Cl. ..... 101/465; 101/466
(58) Field of Search ..... 101/463.1, 465, 101/467, 466; 430/49, 87, 96; 347/95, 99, 105, 106

(56) References Cited

U.S. PATENT DOCUMENTS

| | | | | | |
|---|---|---|---|---|---|
| 4,833,486 | A | * | 5/1989 | Zerillo | 101/463.1 |
| 5,053,301 | A | * | 10/1991 | Kato et al. | 430/49 |
| 5,219,705 | A | * | 6/1993 | Kato et al. | 430/302 |
| 5,368,931 | A | * | 11/1994 | Kato et al. | 101/457 |
| 5,582,106 | A | * | 12/1996 | Kanda et al. | 101/462 |
| 5,677,098 | A | * | 10/1997 | Nakayama et al. | 430/95 |
| 5,714,250 | A | * | 2/1998 | Kato et al. | 101/458 |

* cited by examiner

*Primary Examiner*—Stephen R. Funk
(74) *Attorney, Agent, or Firm*—Reed Smith LLP

(57) ABSTRACT

A process for preparing an ink-jet system printing plate, wherein in a planographic printing plate precursor having an image receiving layer containing zinc oxide and a binder resin on a water-resistant support, the surface of the image receiving layer has a water-contact angle of 50° or more, and image formation is carried out according to a hot melt type ink-jet system by heat melting an ink composition that is solid at ordinary temperature and spraying the droplets of the ink composition in a heat melt state from a nozzle onto the image receiving layer, and a nonimage area of the image receiving layer is then subjected to a desensitizing treatment by a chemical reaction to prepare a planographic printing plate.

7 Claims, 2 Drawing Sheets

PROCESS FOR PREPARING INK JET SYSTEM PRINTING PLATE

FIELD OF THE INVENTION

The present invention relates to a process for preparing a planographic printing plate for an ink-jet recording system, and especially, to a process for preparing a printing plate for a hot melt type ink-jet system which is satisfactory in image quality of both the printing plate and printed matter.

BACKGROUND OF THE INVENTION

On account of the latest progress in office appliances and office automation, an offset planographic printing system spreads throughout the small printing field, in which a printing plate is prepared, that is, image formation is performed, by various processes from a direct-drawing type planographic printing plate precursor which has on a water-resistant support an image receiving layer having a water-receptive surface.

In conventional direct drawing type planographic printing plate materials, image accepting layers (or image receiving layers) containing inorganic pigments, water-soluble resins, and water resisting enhancers are provided on supports such as paper having undergone a water resistance treatment and plastic films. In known processes for preparing printing plates, lipophilic images are formed on such fresh direct drawing type planographic printing plate precursor by the use of lipophilic ink, with typewriters, by handwriting, by hot melt transfer of images from ink ribbons with heat transfer printers, or by the use of ink-jet printers using a liquid ink.

The printing plates thus prepared, however, fail to have sufficient strength in image areas, which readily causes falling off of the image area on printing.

In platemaking by the ink-jet printers in which a liquid ink is used, in order to prevent image forming agents in the liquid ink from diffusing or absorbing into the plate materials and mitigate blur of images, JP-A-64-27953 (The term "JP-A" as used herein means an "unexamined published Japanese patent application") discloses a hot melt type ink-jet process (occasionally referred to as a solid jet process) which uses a hydrophobic solid ink changing to a melted liquid by heating. The image receiving layer of a printing plate precursor used herein has a water-receptive surface.

Even in this process, however, blurs are actually observed in image areas of printed matter obtained from the printing plate thus made, and in addition, the number of sheets which can be printed is insufficient and only a few hundred at most.

SUMMARY OF THE INVENTION

The present invention is directed to resolving such problems, and accordingly, an object of the present invention is to provide a process for preparing a printing plate of a hot melt type ink-jet system from which a number of printed sheets having a sharp image can be obtained.

The object given above has been achieved by embodiments of the present invention as described in the following items (1) to (4):

(1) A process for preparing an ink-jet system printing plate, wherein in a planographic printing plate precursor having an image receiving layer containing zinc oxide and a binder resin on a water-resistant support, the surface of the image receiving layer has a water-contact angle of 50° or more, and image formation is carried out according to a hot melt type ink-jet system by heat melting an ink composition that is solid at ordinary temperature and spraying droplets of the ink composition in a hot melt state from a nozzle onto the image receiving layer and a nonimage area of said image receiving layer is then subjected to a desensitizing treatment by a chemical reaction to prepare a planographic printing plate.

(2) A process for preparing the ink-jet system printing forme as described in item (1), wherein the smoothness of the image receiving layer surface of the planographic printing plate is at least 30 seconds per 10 ml in Bekk smoothness degree.

(3) A process for preparing the ink-jet system printing plate as described in item (1), wherein the ink composition contains a wax having a melting point of from 50 to 150° C., a resin, a color material, and an adhesion modifier and turns to a hot melted liquid by heating the ink composition to 80° C. or more, the hot melted liquid having a viscosity of from 1 to 20 cps.

(4) A process for preparing the ink-jet system printing plate as described in item (1), wherein the smoothness of the support surface adjacent to the image receiving layer is at least 300 seconds per 10 ml in Bekk smoothness degree.

DETAILED DESCRIPTION OF THE INVENTION

Figure 1:
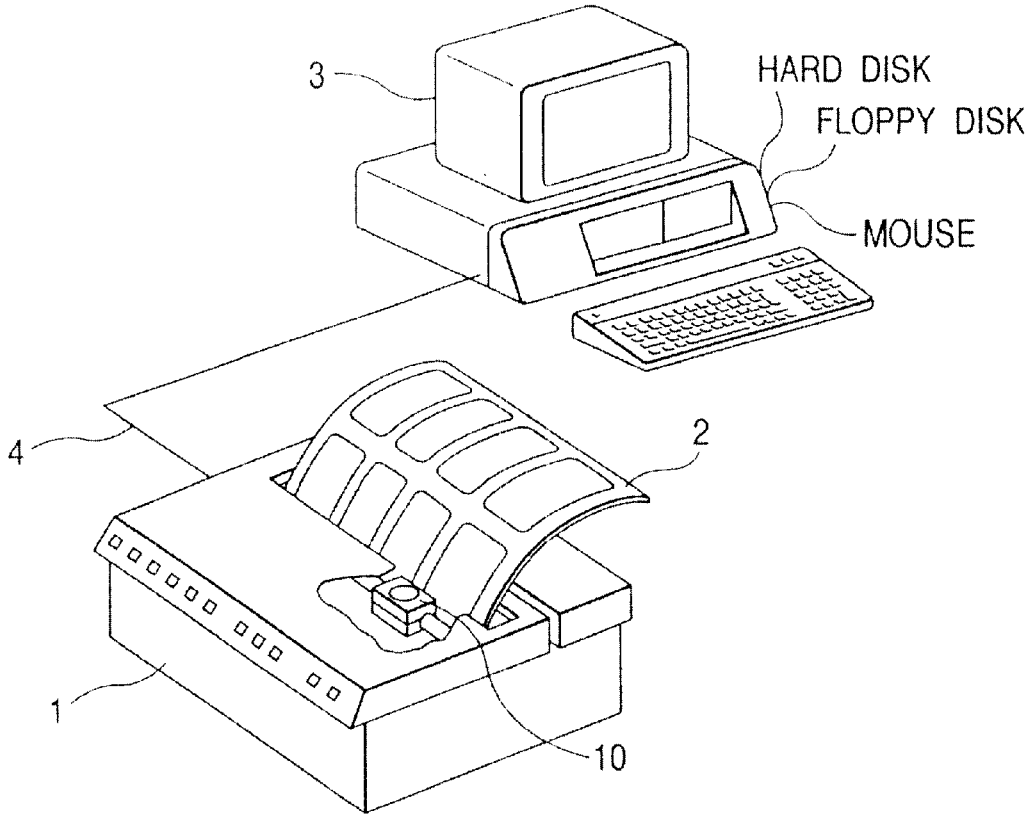
FIG. 1 is a schematic view showing an example of a device system used in the present invention.

The present invention is described in detail below. A feature of the present invention is that an image is formed according to a solid-jet system by spraying a hydrophobic ink composition that is a solid image forming member at ordinary temperature (35° C. or lower) onto an image receiving layer having a hydrophobic surface, and an image layer thus formed sufficiently retains the affinity for the image receiving layer by bonding to or by adhering to the image layer, thus producing a stable image area which has resistance to falling from the image receiving layer.

In this case, the image receiving layer contains zinc oxide and a binder resin, and the degree of hydrophobic nature of the surface thereof is 50° or more in water-contact angle; and in view of ink receptivity, preferably from 50° to 130°, more preferably from 50° to 120°, and particularly preferably from 55° to 110°.

When the water-contact angle is within the scope given above, the above-described strength of the image layer is sufficiently retained and a sharp image is formed without disorder in images such as fine lines, small characters, and halftone dots.

The contact angle is a value measured with a contact angle meter by a droplet method using distilled water.

On the other hand, JP-A-64-27953 discloses a solid-jet system similar to the present invention, in which an image receiving layer of a printing plate precursor has a water-receptive surface that is 20° or less in the water-contact angle, such a surface differing from that of the image receiving layer of the present invention. Such a printing plate precursor is markedly inferior to that of the present invention in image reproducibility and press life.

In the present invention, the smoothness of the surface of the image receiving layer is preferably at least 30 seconds per 10 ml, and more preferably from 45 to 300 seconds per 10 ml in Bekk smoothness degree.

The smoothness of the surface of the image receiving layer which falls in the above-mentioned ranges results in forming sharp images without any defects in image, and in addition, in improving adhesion of the image area to the image receiving layer due to an increase in adhesion area to offer a remarkably improved press life more than 1000 sheets.

The Bekk smoothness degree can be measured with a Bekk smoothness degree testing machine. The testing machine has a circular plate of glass which is finished to a highly smooth surface and has a hole in the middle, in which a specimen is placed on the plate of glass under a constant pressure (1 kg/cm$^2$), and time required for a constant amount of air (10 ml) to pass between the glass plate and the specimen under a reduced pressure is measured.

The adhesion of the image area to the image receiving layer and the press life are particularly improved by maintaining the above-mentioned ranges of the smoothness of the surface of the image receiving layer and by using an ink composition which is solid at ordinary temperature, contains a wax having a melting point of 50 to 150° C., a resin, and an adhesion modifier, and turns to a hot melted liquid having a viscosity of 1 to 20 cps by heating to 80° C. or higher. The probable cause of such improvement consists in increase in affinity between the image receiving layer surface and the ink composition turning to a hot melted liquid, and in addition, in developing no blur of ink to improve image reproducibility.

In addition, in the present invention, the image reproducibility and the press life can be much more improved by restricting the smoothness of the support surface adjacent to the image receiving layer to at least 300 seconds per 10 ml in Bekk smoothness degree. Even when the surface of the image receiving layer has the same smoothness as above, the improved effect can be offered, because an increase in the smoothness of the surface of a support probably improves the adhesion between the image area and the image receiving layer.

A process for preparing the printing plate of the present invention is explained below.

The first explanation refers to a planographic printing plate precursor having an image receiving layer containing at least zinc oxide and a binder resin on a water-resistant support supplied for the present invention.

Zinc oxide used in the present invention include all those which are being marketed as zinc oxide, zinc white, wet zinc white, and activated zinc white as described in *Shinpan Ganryo Binran* (*New Edition Handbook of Pigments*), edited by Nippon Ganryo Gijutsu Kyokai, Seibundo, page 319 (1968).

That is, zinc oxide include those which are called a dry process such as a French process (indirect process) and an American process (direct process) and a wet process according to starting materials and manufacturing process, and they are being marketed, for example, by Seido Chemical Co., Ltd., Sakai Chemical Co., Ltd., Hakusui Chemical Co., Ltd., Honso Chemical Co., Ltd., Toho Zinc Co., Ltd., and Mitsui Mining and Smelting Co., Ltd.

The content of zinc oxide in the image receiving layer is from 90 to 75% by weight, and preferably from 88 to 78% by weight.

The content falling in these ranges promotes the effect of the present invention. A decrease in the zinc oxide content results in insufficient water wettability of the surface of the image receiving layer by the desensitizing treatment, and fails to impart the effect of the present invention. On the other hand, too much zinc oxide makes it difficult to provide the necessary amount of a binder resin.

Binder resins used for the image receiving layer of the present invention are hydrophobic resins which form the image receiving layer together with zinc oxide as described above and adjust the contact angle of the surface of the image receiving layer so as to fall in the above-mentioned ranges. The weight average molecular weight of the resins is preferably from $10^3$ to $10^6$, and more preferably from $5\times10^3$ to $5\times10^5$. The glass transition point of the resins is preferably from 0 to 120° C., and more preferably from 10 to 90° C.

Examples of such the resins include vinyl chloride-vinyl acetate copolymers, styrene-butadiene copolymers, styrene-methacrylate copolymers, methacrylate copolymers, acrylate copolymers, vinyl acetate copolymers, polyvinyl butyral, alkyd resins, epoxy resins, epoxyester resins, polyester resins, and polyurethane resins.

These resins can be used singly or as a mixture of two or more kinds thereof.

The ratio of the resins and zinc oxide in the image receiving layer is preferably from 9/91 to 25/75 and more preferably from 10/90 to 22/78, in resin/zinc oxide weight ratio.

Other constituent components than the above-mentioned components can also be incorporated into the image receiving layer of the present invention.

One such the components constituent components for use in the present invention is an inorganic pigment other than zinc oxide used in the present invention. Examples of such the inorganic pigments include kaolin clay, calcium carbonate, barium carbonate, calcium sulfate, barium sulfate, magnesium carbonate, titanium oxide, silica, and alumina. The amount of these inorganic pigments used together with zinc oxide of the present invention can not exceed 20 parts by weight, based on the zinc oxide.

To improve the desensitizing of the image receiving layer, resin particles such as acrylic acid resin particles containing a particular functional group as described in JP-A-4-201387, JP-A-4-223196, JP-A-4-319491, JP-A-5-58071, JP-A-4-353495, JP-A-5-119545, etc. can be added to the layer. These resin particles are usually spherical and the average particle size thereof is preferably from 0.1 to 2 μm.

Use of said other inorganic pigments or resin particles in the above-mentioned ranges brings about sufficient desensitizing (water wettability) of nonimage areas by a desensitizing treatment, resulting in inhibiting scumming in printed matter, and allows an image area to strongly adhere to the image receiving layer, resulting in developing no image defect in spite of a great number of Eprinted sheets to acquire a sufficient press life.

The amount of binder resins in the image receiving layer is from 10 to 25 parts by weight, preferably from 13 to 22 parts by weight per 100 parts by weight of the pigments (including zinc oxide). These ranges make it possible to efficiently develop the effect of the present invention, and in addition, to maintain film strength on printing and high water wettability acquired by a desensitizing treatment.

Besides, crosslinking agents can be incorporated into the image receiving layer to much more improve film strength.

The crosslinking agents used in the present invention include compounds which are usually used as crosslinking agents, and examples thereof are those described in *Kakyozai Handbook* (*Handbook of Crosslinking Agents*), edited by Shinzo Yamashita and Tosuke Kaneko, Taiseisha, 1981; and *Kobunshi Data Handbook; Kisohen* (*Data Handbook of Polymers; Basic Edition*), edited by Kobunshi Gakkai, Baifukan, 1986.

In the present invention, reaction accelerators can be added, as needed, to the image receiving layer to promote a crosslinking reaction.

When the crosslinkingreaction is of a type forming chemical bonds between functional groups, examples of the crosslinking agents include organic acids (e.g., acetic acid, propionic acid, butyric acid, benzenesulfonic acid, p-toluenesulfonic acid, etc.), phenols (e.g., phenol, chlorophenol, nitrophenol, cyanophenol, bromophenol, naphthol, dichlorophenols, etc.), organic metal compounds (e.g., acetylacetonatozirconium, zirconium acetylacetonate, cobalt acetylacetonate, dibutoxytin dilaurate, etc.), dithiocarbamic acid compounds (e.g., diethyl dithiocarbamate, etc.), thiuram disulfide compounds (e.g., tetramethyl thiuram disulfide, etc.), carboxylic acid anhydrides (e.g., phthalic anhydride, maleic anhydride, succinic anhydride, butylsuccinic anhydride, benzophenone-3,3',4,4'-tetracarboxylic acid dianhydride, trimellitic acid anhydride, etc.). When the crosslinking reaction is of a polymerization reaction type, the polymerization initiators (e.g., peroxide, azobis series compounds, etc.) are used.

After applying an image receiving layer composition, the binder resins are preferably hardened with light and/or heat. Thermal hardening can be carried out, for example, by drying the image receiving layer under more severe conditions than usual. For example, the drying is done at a higher temperature and/or for a longer time as usual, or after drying up the coating solvent, heating is further continued. For example, the drying is performed at 60 to 150° C. for 5 to 120 minutes. Simultaneous use of the reaction accelerators described above enables the drying to be carried out under milder conditions.

Photo-setting of particular functional groups in the binder resins may be also carried out. For hardening by irradiation with light, a step of irradiation with chemically active rays may be inserted into the process. All of visible rays, ultraviolet rays, far ultravioletrays, electron rays, X rays, gamma rays, and alpha rays can be employed as the chemically active rays. Of these, the ultraviolet rays are preferred, and rays falling in the wavelength region of from 310 to 500 nm are more preferred. Low pressure, high pressure, and super high pressure mercury vapor lamps and halogen lamps are employed in general. Irradiation with light can be sufficiently performed at a distance of 5 to 50 cm for 10 seconds to 10 minutes.

In the present invention, the thickness of the image receiving layer is preferably from about 3 to 30 grams per $m^2$ of the printing plate precursor in terms of coating amount (after drying) of the image receiving layer composition.

The image receiving layer of the present invention is provided on a water-resistant support. Paper which has undergone a water resistance treatment, plastic films, paper or plastic films laminated to metal foil, and the like may be employed as the water-resistant supports.

In the supports used in the present invention, the smoothness of the support surface adjacent to the image receiving layer is preferably at least 300 seconds per 10 ml, more preferably from 900 to 3000 seconds per 10 ml, and most preferably from 1000 to 3000 seconds per 10 ml in Bekk smoothness degree.

The highly smooth surfaces of the water-resistant supports restricted herein mean the surfaces on which the image receiving layers are directly provided. For example, when an underlayer or an overcoat layer as described later is provided on the support, the highly smooth surface means the surface of the underlayer or the overcoat layer.

Thus, the surface condition of the image receiving layer adjusted as described above is completely maintained without undergoing the influence of unevenness of the surface of the support to increasingly contribute to improvement in image quality.

Various known methods can be employed to set the surface of a support in the above-mentioned ranges of smoothness. Melt adhesion of a resin to a substrate surface, calender reinforcement by the use of highly smooth heated rollers, and the like can be performed to adjust the Bekk smoothness degree of the surface of the support.

In the present invention, the melt adhesion of the above-mentioned resins is preferably performed according to an extrusion-lamination process. A support adjusted to desired smoothness can be prepared by covering a substrate according to the extrusion-lamination process. In the extrusion-lamination process, a base paper is subjected to pressing to a film immediately after the film is formed from a resin melted, and cooled to be laminated. Various devices are known for the process.

In view of stability to manufacturing, the thickness of the laminated resin layer is 10 μm or more, and preferably from 10 to 30 μm.

Examples of the resins employed for this purpose include polyethylene resins, polypropylene resins, acrylic resins, methacrylic resins, epoxy resins, and copolymers thereof. Two or more kinds of these resins can also be employed at the same time. Of these, the polyethylene resins are preferred, and of the polyethylene resins, mixtures of low-density polyethylene and high-density polyethylene are particularly preferred. The mixtures offer uniform coating film and excellent resistance to heat. When electrically conductive substances are incorporated into the resin layers, use of the mixtures provides excellent electrical conductivity.

The low-density polyethylenes preferably have a density of 0.915 to 0.930 gram/ml and a melt index of 1.0 to 30 grams per 10 minutes, and the high-density polyethylenes preferably have a density of 0.940 to 0.970 gram/ml and a melt index of 1.0 to 30 grams per 10 minutes. Preferred low-density polyethylene/high-density polyethylene blend ratio is 10 to 90%/90 to 10% by weight.

When paper is employed as a substrate, it is preferred to coat the base paper previously with polyethylene derivatives such as ethylene-vinyl acetate copolymers, ethylene-acrylic acid ester copolymers, ethylene-methacrylic acid ester copolymers, ethylene-acrylic acid copolymers, ethylene-methacrylic acid copolymers, ethylene-acrylonitrile-acrylic acid copolymers, or ethylene-acrylonitrile-methacrylic acid copolymers, or to expose the surface of the base paper to corona discharge previously in order to enhance the adhesion between the base paper and the resin layer. As other methods, base paper can also be subjected to surface treatments as described in JP-A-49-24126, JP-A-52-36176, JP-A-52-121683, JP-A-53-2612, JP-A-54-111331, and JP-B-51-25337 (The term "JP-B" as used herein means an "examined Japanese patent publication").

The calender reinforcement, one of the other methods, can be achieved by a calender treatment of a substrate such as paper described later or a support in which an underlayer is formed on a substrate. Conditions of the calender treatment can be appropriately controlled depending on substrates and compositions of an underlayer, and conditions such as the kinds and combinations of rolls such as metal rolls, resin rolls, and cotton rolls, the stage number of calender rolls, roll nip pressure, the surface temperatures of rolls, and the like can be appropriately selected.

In the present invention, an undercoat layer can be provided on the support to improve water resistance between the support and the image receiving layer and adhesion between these layers, and a backcoat layer (backside layer) can be formed on the opposite side of the image receiving layer for the purpose of anticurl. The smoothness of the backcoat layer preferably falls in the range of 150 to 700 seconds per 10 ml in Bekk smoothness degree.

When the printing plate is supplied to an offset press, this enables the printing plate to be precisely placed on the offset press without a gap or sliding.

To adjust the smoothness of the underlayer and backcoat layer for the support, it is desirable that the calender treatment is repeatedly performed, for example, the calender treatment is carried out after formation of the underlayer and the calender treatment is carried out again after formation of the backcoat layer, respectively, or the adjustment of ratios and particle sizes of pigments in compositions used for the underlayer and the backcoat layer as described later is combined with the adjustment of conditions of the calender treatment.

Substrates used for the plate precursors of the present invention are, for examples, wood pulp paper, synthetic pulp paper, paper made from a mixture of wood pulp and synthetic pulp, nonwoven fabric, plastic films, cloth, metal sheets, and composite sheets prepared from these substrates, which are employed without undergoing any treatment. In the present invention, in order to obtain particular smoothness and adjust water resistance and other characteristics, these substrates can be further impregnated with a coating paint comprising a hydrophobic resin, a water-dispersible or water-soluble resin, and a pigment, which are used for the underlayer and the backcoat layer as described later.

In the present invention, to satisfy printing characteristics such as recording characteristics, water resistance, and durability, and at the same time, to adjust the surface of a support to desired smoothness, a support in which an underlayer and a backcoat layer are provided on the substrate described above is preferably employed. Such the underlayer and the backcoat layer are formed by applying a coating paint containing a resin, a pigment, and the like to the substrate and then drying, or by laminating. The resins used herein can be appropriately selected from among various resins. Examples of the resins include hydrophobic resins such as acrylic resins, vinyl chloride resins, styrene resins, styrene-butadiene resins, styrene-acrylic resins, urethane resins, vinylidene chloride resins, and vinyl acetate resins; and hydrophilic resins such as polyvinyl alcohol resins, cellulose derivatives, starch and derivatives thereof, polyacrylamide resins, styrene/maleic anhydride copolymers.

Examples of the pigments include clay, kaolin, talc, diatomaceous earth, calcium carbonate, aluminum hydroxide, magnesium hydroxide, titanium oxide, and mica. To achieve desired smoothness, the particle sizes of these pigments are preferably selected. For example, as relatively high smoothness is demanded as to the underlayer, pigments of smaller particle sizes or excluding large size particles, and concretely, pigments having particle sizes of 8 $\mu$m or less, and preferably of from about 0.5 to 5 $\mu$m are employed for the underlayer. On the other hand, as the backcoat layer is required to have lower degree of smoothness than the underlayer, pigments having relatively larger particle sizes, and concretely, pigments having particle sizes of 0.5 to 10 $\mu$m are preferably employed. The ratio of these pigments to the resins is preferably from 80 to 150 parts by weight for the underlayer, and from 80 to 200 parts by weight for the backcoat layer per 100 parts by weight of the resins. To obtain excellent resistance to water, the underlayer and the backcoat layer can efficiently contain water-resisting agents such as melamine resins and polyamideepichlorohydrin resins. The above-mentioned particle sizes can be measured with a scanning electron micrograph. When the particles are nonspherical, diameters of such the particles are diameters obtained by converting the projected areas to circles.

To prepare the planographic printing plate precursor of the present invention, a solution containing components for the underlayer is applied, if necessary, to one side of a support and then dried to form an underlayer, and further a solution containing components for the backcoat layer is applied, if necessary, to another side of the support and then dried to form the backcoat layer. Thereafter, a solution containing components for the image receiving layer is applied to the underlayer and then dried to form the image receiving layer. The coating amounts for the image receiving layer, the underlayer, and the backcoat layer are preferably from 1 to 30 grams/$m^2$, and particularly suitably from 6 to 20 grams/$m^2$, respectively.

The thickness of the water-resistant support on which the underlayer or the backcoat layer are formed ranges from 90 to 130 $\mu$m, and preferably from 100 to 120 $\mu$m.

A solid ink used for a hot melt type ink-jet system (or solid jet system), which is an ink composition that is solid at ordinary temperature, is described below.

The solid ink used for the present invention is solid at a temperature of 35° C. or lower and turns to a hot melted liquid by heating to a temperature of 80 to 150° C. In addition, the viscosity at the hot melt ranges from 1 to 20 cps, and preferably from 2 to 15 cps. Known materials are used for the solid ink.

The hot-meltable ink of the present invention contains at least a wax which is solid at ordinary temperature and has a melting point of 50 to 150° C., a resin, a color material, and an adhesion modifier, and preferably has contents of 30 to 90% by weight of the wax having a melting point of 50 to 150° C., 5 to 70% by weight of the resin, 0.1 to 10% by weight of a dye or pigment as the color material, and 2 to 40% by weight of the adhesion modifier.

The wax which is used as a component of the vehicle and has a melting point of 50 to 150° C. must be stable to heat in a hot melt state heated to not less than its melting point, or at least at ink-jetting temperature of an ink-jet printer.

Examples of such the waxes include petroleum waxes (desirably, paraffin wax and microcrystalline wax), vegetable waxes (desirably, candellia wax, carnauba wax, rice wax, hohoba solid wax), animal waxes (desirably, bees wax, hydrous lanolin, and spermaceti), mineral waxes (desirably, montan wax), synthetic hydrocarbons (desirably, Fischer-Tropsch wax and polyethylene wax), hydrogenated waxes (desirably, hardened castor oil and hardened castor oil derivatives), modified waxes (desirably, montan wax derivatives, paraffin wax derivatives, microcrystalline wax derivatives, and polyethylene wax derivatives), higher fatty acids (desirably, behenic acid, stearic acid, palmitic acid, myristic acid, and lauric acid), higher alcohols (desirably, stearyl alcohol and behenyl alcohol), hydroxystearic acids (desirably, 12-hydroxystearic acid and 12-hydroxystearic acid derivatives), ketones (desirably, stearone and laurone), fatty acid amides (desirably, lauric acid amide, stearic acid amide, oleic acid amide, erucic acid amide, ricinoleic acid amide, 12-hydroxystearic acid amide, special fatty acid amides, and N-substituted fatty acid amides), amines (desirably, dodecylamine, tetradecylamine, and octadecylamine), esters (desirably, methyl stearate, octadecyl stearate, glycerin fatty acid esters, sorbitan fatty acid esters, propylene glycol fatty acid esters, ethylene glycol fatty acid esters, and polyoxyethylene fatty acid esters), and polymerized waxes (desirably, α-olefin-maleic anhydride copolymers wax). These known waxes can be used without any particular limitation, and singly or as a mixture of two or more kinds thereof. The content of the waxes in the entire ink preferably ranges from 30 to 90% by weight.

The resins which is a component of vehicle together with the waxes act so as to give adhesion to printing paper to control the viscosity of the ink, to prevent waxes from being crystallized, and in addition, to give transparency to the ink.

The resins are preferably oil-soluble resins. Examples of the oil-soluble resins include olefin resins (preferably, polyethylene resins, polypropylene resins, and polyisobutylene resins), vinyl resins (preferably, ethylene-vinyl acetate copolymer resins, vinyl chloride-vinyl acetate copolymer resins, vinyl acetate resins, and ethylene-vinyl chloride-vinyl acetate copolymer resins), acrylic resins (preferably, methacrylate resins, polyacrylate resins, ethylene-ethyl acrylate copolymer resins, and ethylene-methacrylate copolymer resins), phenol resins, polyurethane resins, polyamide resins, polyester resins, ketone resins, alkyd resins, rosin resins, hydrogenated rosin resins, petroleum resins, hydrogenated petroleum resins, maleic acid resins, butyral resins, terpene resins, hydrogenated terpene resins, and chroman-indene resins. These resins (polymeric materials) can be employed singly or as a mixture of two or more kinds thereof. The content of the resins in the entire ink preferably ranges from 5 to 70% by weight.

All dyes and pigments employed hitherto for oily ink compositions can be employed as the color materials.

Both inorganic and organic pigments commonly employed in the field of printing technology are employed as the pigments. Examples thereof include carbon black, cadmium red, molybdenum red, chrome yellow, cadmium yellow, titanium yellow, chromium oxide, viridian, titanium cobalt green, ultramarine blue, Prussian blue, cobalt blue, azo pigments, phthalocyanine pigments, quinacridone pigments, isoindolinone pigments, dioxazine pigments, indanthrene pigments, perylene pigments, perinone pigments, thioindigo pigments, quinophthalone pigments, and metal complex pigments. These known pigments can be employed without any particular limitation.

Oil-soluble dyes are preferred as the dyes for this purpose, and examples thereof include azo dyes, metal complex dyes, naphthol dyes, anthraquinone dyes, indigo dyes, carbonium dyes, quinoneimine dyes, xanthene dyes, cyanine adyes, quinoline dyes, nitro dyes, nitroso dyes, benzoquinone dyes, naphthoquinone dyes, phthalocyanine dyes, and metallo-phthalocyanine dyes.

These pigments and dyes can be employed singly or in combination, respectively. The content of these pigments and dyes in the whole ink preferably ranges from 0.1 to 10% by weight.

The adhesion modifiers used herein efficiently give plasticity and stickiness to the heat-melting ink in a solid state to remarkably improve fixing to recording sheets and fixing of recording dots to one another without largely changing the viscosity, melting point, and energy of melting of the entire ink. Examples of the adhesion modifiers include polyolefins and derivatives thereof (for example, polyolefin polyols, etc.). The content of the adhesion modifiers in the entire ink preferably ranges from 2 to 40% by weight.

In addition, various additives such as dispersants and rust preventives can also be incorporated into the ink of the present invention. The ink of the present invention can be prepared by mixing the above-mentioned materials with the aid of heat. Melting points of the ink can be variously set, depending on the kinds of constituent components used and mixing ratios thereof. The melting points can be measured with conventional melting point apparatus or by the use of devices for thermal analysis such as DSC and DTA.

A process for forming images on the above-mentioned planographic printing plate precursor (hereinafter occasionally referred to as a "master") is illustrated below. One of systems for executing such a process is shown in FIG. 1.

The system shown in FIG. 1 has ink-jet recording device 1 obeying the solid-jet system in which a solid ink is used.

As shown in FIG. 1, pattern information of images (figures and writings) that should be formed on master 2 is first supplied from an information source such as computer 3 via a transfer means such as path 4 to ink-jet recording device 1 of the solid-jet system. In ink-jet recording head portion 10 of the recording device 1, a solid ink is melted and stored in an ink tank, and when master 2 passes through recording device 1, minute droplets of the ink are sprayed on to master 2 according to the above-mentioned information, so that the ink adheres to master 2 in the above-mentioned pattern.

The adhering image forming agents are spontaneously solidified. An image is thus formed on master 2 to obtain a master (printing plate precursor).

Constitution of the ink-jet recording device in the device system of FIG. 1 is shown, as an example, in FIG. 2 to FIG. 5. In FIG. 2 to FIG. 5, members common to those in FIG. 1 are indicated by the same signs.

Figure 2:
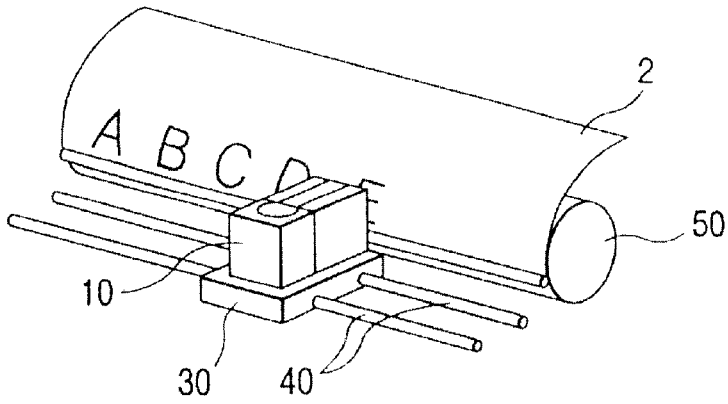
FIG. 2 is a schematic view showing an important portion of an ink-jet recording device used in the present invention.

FIG. 2 is a schematic view showing an important portion of such an ink-jet recording device. The ink-jet device of FIG. 2 has head portion 10 in which a solid ink is heated to melt and the liquified ink is sprayed from a nozzle, carriage 30 to bear head portion 10, guide 40 along which carriage 30 moves, and platen 50 to which master 2 is supplied.

In such the constitution, head portion 10 borne by carriage 30 moves right and left along guide 40 according to a printout signal from the device of the upper stream, and sprays the liquified ink through the nozzle onto master 2, thus printout being carried out.

Figure 3:
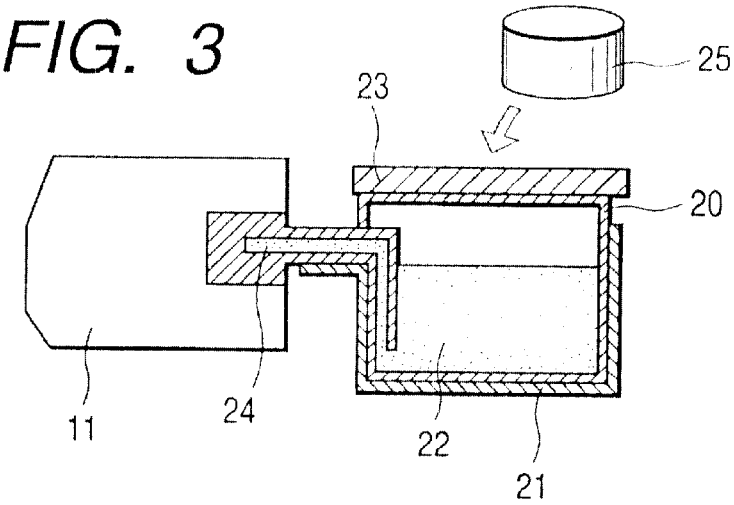
FIG. 3 is a schematic view showing a head portion of the ink-jet recording device used in the present invention.

FIG. 3 is a schematic view showing head portion 10 in the above-mentioned ink-jet recording device. As shown in FIG. 3, head portion 10 is mainly constituted by ink-jet head 11 and ink tank 20, Further, it also has means 21 for heat melting solid ink 25. For example, a heating resistor can be employed for such a means, and the heating resistor is employed in the explanation given herein. Ink 22 melted with heating resistor 21 is placed in ink tank 20 of head portion 10, and ink tank 20 is fitted with tank cap 23. Head portion 10 has ink supplying path 24 through which melted ink 22 in ink tank 20 is supplied to ink-jet head 11.

When an operator supplies solid ink 25 to ink tank 20, solid ink 25 is heated and melted by heating resistor 21 provided so as to wrap ink tank 20, and supplied to ink-jet head 11 through ink supplying path 24.

Figure 4:
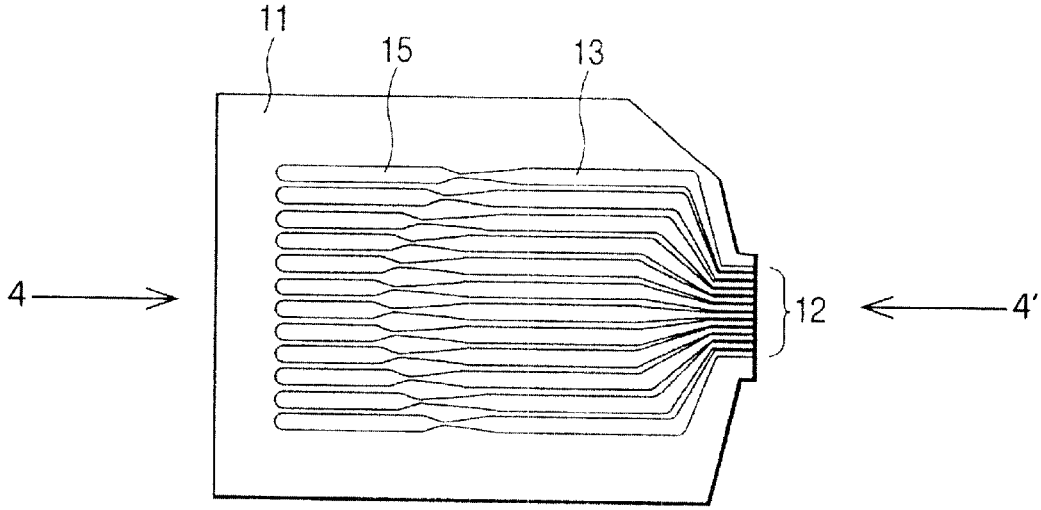
FIG. 4 is a schematic view showing an ink-jet head in the head portion of the ink-jet recording device used in the present invention.
Figure 5:
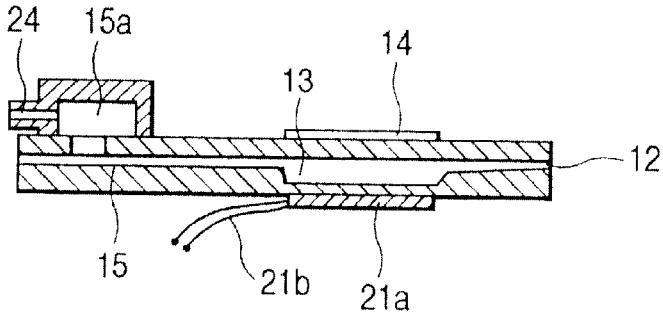
FIG. 5 is a cross-sectional view along the lines 4–4' of FIG. 4.

FIG. 4 is a schematic view to illustrate the above-mentioned ink-jet head 11. As shown in FIG. 4, ink-jet head 11 is made up of nozzle 12, pressurizing chamber 13, piezo-electric element 14 for pressurizing the ink in pressurizing chamber 13, common ink chamber 15, ink supplying exit 15*a*, heating resistor 21*a* for heating melted ink 22 to maintain it at a constant temperature, and electrode 21*b*. Melted ink 22 supplied from common ink chamber 15 to pressurizing chamber 13 is sprayed from nozzle 12 by the drive of piezo-electric element 14, while melted ink 22 is maintained at optimum temperature for spraying by heating resistor 21*a*. Sprayed melted ink 22 adheres to master 2, permeates the master, and solidifies to achieve grab.

Although the above-mentioned ink-jet head 11 is illustrated by the use of an electromechanical transducer such as the piezo-electric element, a similar effect as above can also be obtained by other pressurizing means such as a wire type pressurizing system. Further, a heating means such as a ceramic heater can also be employed as well as the heating resister. The temperature of melted ink 22 in ink tank 20 is not required to be as high as that of the ink in pressurizing chamber 13 immediately before being sprayed. Therefore, heating resistor 21 provided outside ink tank 20 and heating resistor 21*a* provided outside pressurizing chamber 13 may be separately operated to depress an increase in temperature within the ink-jet recording device.

On the other hand, when ink tank 20 and ink-jet head 11 are heated to a similar temperature, it also is possible to separately heat ink tank 20 and ink-jet head 11 by heating resistors 21 and 21*a* as described above; However, both ink tank 20 and ink-jet head 11 may be covered as one body with a heating system into which a nichrome wire is incorporated.

The temperature of the head of the ink-jet recording device is set in the range of 80 to 150° C., and preferably in the range of 90 to 130° C.

Techniques for employing a solid ink can be widely utilized for the recording head used herein, and in addition, it is desirable to employ a recording head giving high resolving power.

For example, a sharp image with a resolving power of 600 dpi can be formed by supplying a solid ink to ink tank 20 of the ink-jet recording device of FIG. 2 and spraying a melted ink having a particle size of 60 $\mu$m from a nozzle having a diameter of 40 $\mu$m under the conditions of a head heating temperature of 120° C., a piezo-electric element drive voltage of 70 volts, and a sprayed ink viscosity of 20 cps.

Subsequently, a master thus prepared by forming an image on a planographic printing plate precursor according to the solid-jet system is subjected to a surface treatment performed by the use of a desensitizing solution to desensitize the nonimage area, to prepare a printing plate.

For desensitizing zinc oxide, processing solutions which contain cyan compounds such as ferrocyanates or ferricyanates as main components; cyan-free processing solutions which contain ammine cobalt complexes, phytic acid or derivatives thereof, or guanidine derivatives as main components; processing solutions which contain as main components inorganic or organic acids that react with zinc ion to form chelates; and processing solutions which contain water-soluble polymers are known as the desensitizing solutions.

The processing solutions which contain the cyan compounds include, for example, those described in JP-B-44-9045, JP-B-46-39403, JP-A-52-76101, JP-A-57-107889, JP-A-54-117201, etc.

The processing solutions which contain the phytic acid and derivatives thereof include those listed in JP-A-53-83807, JP-53-83805, JP-A-53-102102, JP-A-53-109701, JP-A-53-127003, JP-A-54-2803, JP-A-54-44901, etc.

The processing solutions which contain metal complex compounds such as cobalt complexes include those listed in JP-A-53-104301, JP-A-53-140103, JP-A-54-18304, and JP-B-43-28404.

The processing solutions which contain the inorganic or organic acids include those listed in JP-B-39-13702, JP-B-40-10308, JP-B-43-28408, JP-B-40-26124, JP-A-51-118501, etc.

The processing solutions which contain the guanidine compounds include those described in JP-A-56-111695, etc.

The processing solutions which contain the water-soluble polymers include those described in JP-A-52-126302, JP-A-52-134501, JP-A-53-49506, JP-A-53-59502, JP-A-53-104302, JP-B-38-9665, JP-B-39-22263, JP-B-40-763, JP-B-40-2202, JP-A-49-36402, etc.

In all these desensitizing processes, it is assumed that zinc oxide in a surface layer is ionized to become a zinc ion, and the ion undergoes a chelate reaction with chelate forming compounds in desensitizing processing solutions to produce zinc-chelated compounds, which are precipitated on surface layers that are made water-receptive.

Desensitizing is usually performed at ordinary temperature (about 15 to 35° C.) for about 2 to 60 seconds. This printing plate can endure offset printing of about 3000 sheets by the use of fountain solution.

The present invention is illustrated below by examples in detail. However, the contents of the present invention is not limited by these examples.

EXAMPLE 1

A mixture of 100 grams of dry zinc oxide, 3.0 grams of binder resin (B-1) and 17.0 grams of binder resin (B-2) (Both the binder resins have the following structures), 0.15 gram of benzoic acid, and 155 grams of toluene were dispersed for 8 minutes at $1\times10^4$ rpm with a wet dispersing homogenizer (manufactured by Nippon Seiki Co., Ltd.).

Binder Resin (B-1) Mw: $9 \times 10^3$

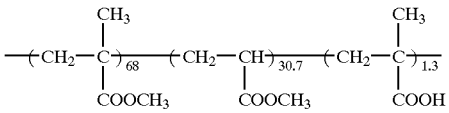

Binder Resin (B-2) Mw: $4 \times 10^4$

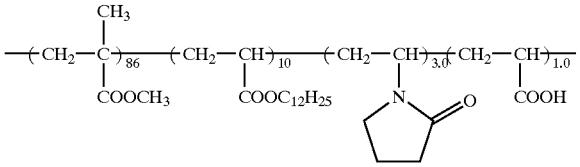

(Numerical values indicate a weight ratio of starting monomers; Mw: Weight-average molecular weight)

The composition given above was applied with a wire bar to a support (having an underlayer with a smoothness degree of 500 seconds per 10 ml) of ELP-1 type master (trade name, manufactured by Fuji Photo Film Co., Ltd.) which is employed as an electrophotographic planographic printing plate precursor for small printing, and dried at 100° C. for 1 minute to form an image receiving layer, coating amount of which was 8 grams/$m^2$. A printing plate precursor thus prepared is designated as sample No. 1.

The smoothness degree of the surface of the image receiving layer on the printing plate precursor, which was measured by a method described later, was 200 seconds per 10 ml.

Similarly to No. 1, a planographic printing plate precursor was prepared except that a support of ELP-1X type master (trade name, manufactured by Fuji Photo Film Co., Ltd.) was employed in place of the support of ELP-1 type master which was employed as a water-resistant support. The support of ELP-1X type master has an underlayer with a smoothness degree of 1800 seconds per 10 ml. The printing plate precursor is designated as sample No. 2.

Further, a commercially available direct-drawing printing plate precursor having a water-receptive image receiving layer surface is employed as sample No. 3.

About samples No. 1 to No. 3, the water-contact angles and the smoothness degrees were measured in the following manner. The results are shown in Table 1.

1) 2 $\mu$l of distilled water was placed on the respective surfaces of the printing plate precursors, and the surface contact angles (degree) were measured after 30 seconds with a surface contact angle gauge (CA-D, manufactured by Kyowa Kaimenkagaku Co., Ltd.). Lower values thereof exhibit better water wettability, which indicates that the surface is more water-receptive.

2) Smoothness Degree of Image Receiving Layer

The smoothness degree (second/10 ml) of the printing plate precursors was measured by the use of a Bekk smoothness testing machine (manufactured by Kumagaya Riko Co., Ltd.) at an air volume of 10 ml.

The smoothness degrees of the supports as indicated above also were measured in the same manner as described here. Phaser 340 JS Printer (manufactured by Sony-Tektronix Co., Ltd.) which is commercially available as a solid-jet printer was converted so that ink sprayed from an nozzle can directly form an image on a printing plate precursor, and planographic printing plate precursors were made by the use of this converted recording device and a black solid ink (Inkstick Black: an accessory of the printer).

The converted recording device is accordant with constitution shown in FIG. 2 to FIG. 4. The black solid ink contain a wax having a melting point of about 100° C., and the ink melted at about 120° C. has a viscosity of about 20 cps.

Quality of duplicated images on the printing plate precursors thus prepared was evaluated in the following manner. The results are shown in Table 1.

3) Image Quality of Printing Plates

The duplicated images of the printing plates prepared were examined at ×200 magnification with an optical microscope to evaluate image quality. The results of evaluation are indicated by signs ⊙, ○, Δ, X, and XX.

◎ Duplicated images have no problem at all. Fine lines and small characters also are very good.

○ Duplicated images have no problem. Fine lines and small characters also are good.

Δ A very little falling is observed in fine lines and small characters of Mincho type, and blurs also are slightly observed therein. Slightly inferior.

X A little falling is observed in fine lines and small characters, and blurs also are observed therein. Bad.

XX Falling is observed in fine lines and small characters of Mincho type, and blurs are observed therein. Very bad.

After platemaking was performed as described above, a desensitizing solution (ELP-E2: trade name, manufactured by Fuji Photo Film Co., Ltd.) was placed in the etcher section of a fully-automatic printing machine (AM-2850, trade name, manufactured by A.M. Co., Ltd.), and a solution prepared by diluting a desensitizing solution (SICS) four times with distilled water was placed in the fountain solution saucer of the printing machine. Thereafter, the printing plates were placed on the printing machine, and printing was performed by the use of a black ink for offset printing.

Sample No. 3 is a printing plate precursor having an image receiving layer with a water-receptive surface, and therefore, printing was performed without the desensitizing treatment.

Images on printed matter and press lives of the printing plates were evaluated in the following manners, respectively. The results are shown in Table 1.

4) Printed Images

Images on the tenth printed sheets were visually examined with a magnifying glass of ×20 magnification (scumming, uniformity in screen tint areas, and uniformity of solid in image areas). The results of evaluation are indicated by signs ◎, ○, Δ, X, and XX.

◎ Duplicated images have no problem at all. Fine lines and small characters are very good.

○ Duplicated images have no problem. Fine lines and small characters also are good.

Δ A very little falling is observed in fine lines and small characters of Mincho type, and blurs are slightly observed therein, slightly inferior.

X A little falling is observed in fine lines and small characters of Mincho type, and blurs are slightly observed therein. Bad.

XX Falling is observed in fine lines and small characters, and blurs are observed therein. Very bad.

5) Press Lives

The numbers of printed matter until the scumming or falling of image is observed by the visible eyes were examined.

TABLE 1

| | Characteristics of Printing Plate Precursor | | | | | |
|---|---|---|---|---|---|---|
| | Image Receiving Layer | | | Image | Image | |
| Sample No. | Water-Contact Angle (deg) | Smoothness Degree (sec/10 ml) | Support Smoothness Degree (sec/10 ml) | Quality of Printing Plate Precursor | Quality of Printed Matter | Press Lives (sheets) |
| 1 (Present Invention) | 106 | 200 | 500 | ○ | ○ | 1500 |
| 2 (Present Invention) | 106 | 200 | 1800 | ◎ | ◎ | 1500 |
| 3 (Comparative Example) | 5 | 200 | 1800 | xx* | xx* | 20 |

*Blurs are observed in fine lines and small characters.

The results shown in Table 1 are considered as follows.

The smoothness of the image receiving layers of samples No. 1 to No. 3 was nearly equivalent in Bekk smoothness degree. About wetting properties of the respective printing plate precursors, samples No. 1 and No. 2 had high water-contact angles, which showed that these samples had very hydrophobic surfaces. On the other hand, sample No. 3 had a low water-contact angle, which showed that this sample had a very water-receptive surface.

About image quality of the printing plates, sample No. 2 was very satisfactory and sharp, and sample No. 1 exhibited satisfactory reproducibility in fine lines and small characters. That is, this shows that higher smoothness of an underlayer surface adjacent to an image receiving layer forms better image on a printing plate. However, in sample No. 3, striking blurs were observed in fine lines and small characters.

EXAMPLE 2

Preparation of Water-Resistant Support

An aqueous latex of an ethylene-methyl acrylate-acrylic acid copolymer (molar ratio: 65:30:5) was applied to both sides of wood free paper with a weighing of 95 grams/$m^2$ so as to become 0.2 gram/$m^2$ in dry coating amount, and dried. An uniform polyethylene film of 25 $\mu$m in thickness (surface specific resistivity: $6\times10^6$ Ω) was laminated to one side of the substrate thus obtained through an extruding process by the use of pellets prepared by melting and kneading a mixture of 70% of low-density polyethylene with a density of 0.920 gram/ml and a melt index of 5.0 grams per 10 minutes, 1.5% of high-density polyethylene with a density of 0.950 gram/ml and a melt index of 8.0 grams per 10 minutes, and 15% of electrically conductive carbon. The smoothness degree was then adjusted to 2000 seconds per 10 ml by a calender treatment.

Further, a coating for a backcoat layer having the following composition was applied to another side of the substrate with a wire bar to provide a backcoat layer in dry coating amount of 20 grams (surface specific resistivity: $8\times10^7$ Ω). A calender treatment was then performed so that the backcoat layer has a smoothness degree of 450 seconds per 10 ml.

| [Coating for Backcoat Layer] | |
|---|---|
| Clay (50% Aqueous Dispersion) | 200 parts by weight |
| Oxidized Starch (20% Aqueous Solution) | 40 parts by weight |
| SBR Latex (Solid Content 49%, Tg 10° C.) | 150 parts by weight |
| Initial Condensation Product of Melamine Resin (Solid Content 80%, Sumirez Resin SR-613) | 10 parts by weight |

A corona discharge treatment was performed to the surface of the polyethylene layer at 5 KVA·sec/$m^2$, and an image receiving layer is provided on the support thus prepared in the following manner to prepare a planographic printing plate precursor.

Preparation of Planographic Printing Plate Precursor

Similarly to example 1, a mixture of 100 grams of dry zinc oxide (manufactured by Seido Chemical Co., Ltd.), 16 grams of binder resin (B-3) and 4 grams of binder resin (B-4) (Both the binder resins have structures given below), 0.36 gram of 3-propoxybenzoic acid, and 155 grams of toluene was dispersed at $1\times10^4$ rpm with a wet dispersing machine, KADY mill, for 20 minutes.

Binder Resin (B-3) Mw: 5 x $10^4$

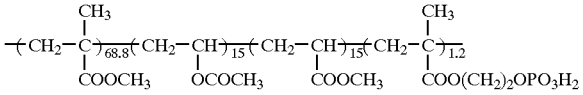

Binder Resin (B-4) Mw: 6 x $10^3$

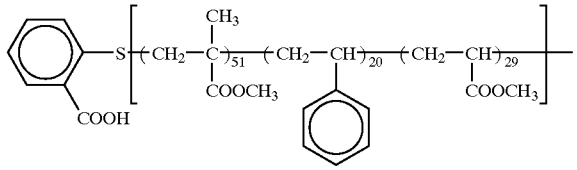

(Numerical values indicate a weight ratio of starting monomers; Mw: Weight-average molecular weight)

The resulting dispersion was applied to the above-mentioned water-resistant support with a wire bar so as to become 12 grams/$m^2$ in coating amount, and dried to prepare a planographic printing plate precursor having a surface smoothness degree of 150 seconds per 10 ml.

Similarly to example 1, the printing plate precursor thus prepared was subjected to platemaking and a desensitizing treatment to make a printing plate which was employed for offset printing.

Similarly to sample No. 2 of example 1, at least 3000 sheets of printed matter having no scumming in nonimage areas and having sharp image quality were obtained. It is seen that the printing plate is excellent in both printed image and press life.

EXAMPLE 3

Preparation of Water-Resistant Support

Wood free paper with a weighing of 100 grams/$m^2$ was employed as a substrate, and a coating paint for an underlayer having the following composition was applied to one side of the substrate with a wire bar to provide an underlayer of 10 grams/$m^2$ in dry coating amount. The surface of the underlayer had a smoothness degree of 150 seconds per 10 ml, and was adjusted to 1500 seconds per 10 ml by a calender treatment.

| [Coating for Underlayer] | |
|---|---|
| Silica Gel | 10 parts by weight |
| SBR Latex (50 wt % Aqueous Dispersion, Tg 25° C.) | 92 parts by weight |
| Clay (45 wt % Aqueous Dispersion) | 110 parts by weight |
| Melamine (80 wt % Aqueous Solution) | 5 parts by weight |
| Water | 191 parts by weight |

Further, a coating paint for a backcoat layer having the following composition was applied to another side of the substrate with a wire bar to provide the backcoat layer of 12 grams/$m^2$ in dry coating amount, and a calender treatment was performed so that the smoothness degree of the backcoat layer was adjusted to about 50 seconds per 10 ml.

| [Coating for Backcoat Layer] | |
|---|---|
| Kaolin (50% Aqueous Dispersion) | 200 parts by weight |
| Polyvinyl Alcohol Aqueous Solution (10%) | 60 parts by weight |
| SBR Latex (Solid Content 49%, Tg 0° C.) | 100 parts by weight |
| Initial Condensation Product of Melamine Resin (Solid Content 80%, Sumirez Resin SR-613) | 5 parts by weight |

Preparation of Planographic Printing Plate Precursor

Similarly to example 2, a mixture of 100 grams of dry zinc oxide (manufactured by Seido Chemical Co., Ltd.), 16 grams of binder resin (B-3) and 4 grams of binder resin (B-4) (Both the binder resins have the structures shown above in example 2), 0.36 grams of 3-propoxybenzoic acid, and 155 grams of toluene was dispersed at $1\times10^4$ rpm with a wet dispersing machine, KADY mill, for 20 minutes.

The resulting dispersion was applied to the above-mentioned water-resistant support with a wire bar so as to be 12 grams/$m^2$ in coating amount, and dried, thus to prepare a planographic printing plate precursor having a surface smoothness degree of 150 seconds per 10 ml.

Similarly to example 1, the printing plate precursor thus prepared was subjected to platemaking and a desensitizing treatment to perform offset printing.

Similarly to sample No. 2, at least 3000 sheets of printed matter having no scumming in nonimage areas and having sharp image quality were obtained. It is seen that printing plate is excellent in both printed image and press life.

EXAMPLE 4

Preparation of Planographic Printing Plate Precursor

Similarly to example 1, a mixture of 100 grams of dry zinc oxide (manufactured by Seido Chemical Co., Ltd.), 14 grams of binder resin (B-5) having a structure given below, 1.5 grams (as solid content) of a dispersion of acrylic acid resin particles described below, 0.20 gram of m-toluic acid, and 230 grams of toluene was placed together with 200 grams of glass beads having diameters of 0.7 to 1 mm in a DYNO mill dispersing machine (manufactured by Shinmaru Enterprise Co., Ltd.), and dispersed at $5\times10^3$ rpm for 10 minutes. The glass beads were separated by filtration, and the filtrate was employed as a coating paint for an image receiving layer.

Binder Resin (B-5) Mw: $5 \times 10^4$

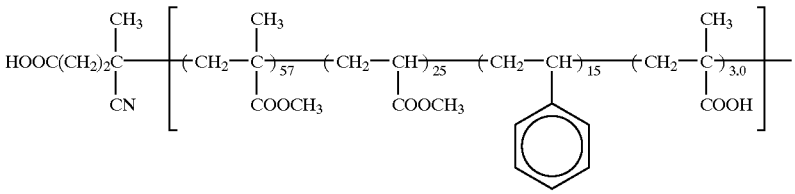

(Numeral values show a weight ratio of starting monomers; Mw: Weight-average molecular weight)

Dispersion of Acrylic Acid Resin Particles:

A solution of 8 grams of acrylic acid, 2 grams of AA-6 (trade name of methyl methacrylate macromonomer, manufactured by Toagosei Co., Ltd.), 2 grams of ethylene glycol dimethacrylate, and 0.1 gram of methyl 3-mercaptopropionate in 55 grams of methyl ethyl ketone was heated to 60° C. in a stream of nitrogen. Subsequently, 0.2 gram of 2,2'-azobis(isovaleronitrile) was added to the heated mixture, and the resulting mixture was allowed to react for 3 hours, and 0.1 gram of the initiator was further added thereto to continue the reaction for 4 hours.

The dispersion thus prepared was applied to a water-resistant support similar to that used for sample No. 2 of example 1 so as to become 18 grams/$m^2$ in coating amount, and dried to prepare a planographic printing plate precursor. The-smoothness of the surface of an image receiving layer thus provided was 160 seconds per 10 ml in Bekk smoothness degree.

Similarly to example 1, the printing plate precursor was subjected to platemaking and a desensitizing treatment to prepare a printing plate to perform offset printing.

Similarly to sample No. 2 of example 1, at least 3000 sheets of printed matter having no scumming in nonimage areas and having sharp image quality were obtained. It is seen that the printing plate has a satisfactory press life.

Thus, printed matter having sharp images and printing plates having excellent press lives can be formed by the present invention.

While the invention has been described in detail and with reference to specific embodiments thereof, it will be apparent to one skilled in the art that various changes and modifications can be made therein without departing from the spirit and scope thereof.

What is claimed is:

1. A process for preparing an ink-jet system printing plate comprising:

heat melting an ink composition that is solid at temperatures of 35° C. or lower, spraying droplets of the ink composition in a heat melted state from a nozzle onto an image receiving layer containing zinc oxide and a binder resin on a water-resistant support, the surface of the image receiving layer having a water-contact angle of 50° or more, and then subjecting a nonimage area of the image receiving layer to a desensitizing treatment by a chemical reaction to prepare a planographic printing plate.

2. A process for preparing an ink-jet system printing plate as claimed in claim 1, wherein the image receiving layer surface of the p-lanographic printing plate precursor has a surface smoothness of at least 30 seconds per 10 mil in Bekk smoothness degree.

3. A process for preparing an ink-jet system printing plate as claimed in claim 1, wherein said ink composition contains a wax having a melting point of from 50 to 150° C., a resin, a color material, and an adhesion modifier and turns to a heat melted liquid by heating the ink composition to 80° C. or higher, the heat melted liquid having a viscosity of from 1 to 20 cps.

4. A process for preparing an ink-jet system printing plate as claimed in claim 1, wherein the image receiving layer has a support surface adjacent to the image receiving layer, said support surface having a Bekk smoothness degree of at least 300 seconds per 10 ml.

5. The process of claim 1 wherein the contact angle is not more than 130°.

6. The process of claim 1 wherein the contact angle is not more than 120°.

7. The process of claim 1 wherein the contact angle is not more than 110°.

* * * * *